US011101573B2

(12) United States Patent
Adada et al.

(10) Patent No.: US 11,101,573 B2
(45) Date of Patent: Aug. 24, 2021

(54) OPEN ENDED WAVEGUIDE ANTENNA FOR ONE-DIMENSIONAL ACTIVE ARRAYS

(71) Applicant: Sea Tel, Inc., Concord, CA (US)

(72) Inventors: Rami Adada, Walnut Creek, CA (US); Wei-Jung Guan, Walnut Creek, CA (US)

(73) Assignee: Sea Tel, Inc., Concord, CA (US)

( * ) Notice: Subject to any disclaimer, the term of this patent is extended or adjusted under 35 U.S.C. 154(b) by 115 days.

(21) Appl. No.: 16/458,507

(22) Filed: Jul. 1, 2019

(65) Prior Publication Data

US 2020/0006865 A1 Jan. 2, 2020

Related U.S. Application Data

(60) Provisional application No. 62/693,290, filed on Jul. 2, 2018.

(51) Int. Cl.

| | |
|---|---|
| ***H01Q 21/24*** | (2006.01) |
| ***H01Q 21/06*** | (2006.01) |
| ***H01Q 13/02*** | (2006.01) |
| ***H01Q 15/24*** | (2006.01) |

(52) U.S. Cl.

CPC ..... *H01Q 21/24* (2013.01); *H01Q 13/02* (2013.01); *H01Q 13/0258* (2013.01); *H01Q 15/24* (2013.01); *H01Q 21/06* (2013.01); *H01Q 21/064* (2013.01)

(58) Field of Classification Search

CPC .... H01Q 21/24; H01Q 15/24; H01Q 13/0258; H01Q 21/064; H01Q 21/06; H01Q 13/02

USPC ..... 343/700 R

See application file for complete search history.

(56) References Cited

U.S. PATENT DOCUMENTS

| | | | | |
|---|---|---|---|---|
| 4,952,894 | A * | 8/1990 | Connerney | H01P 5/12 333/113 |
| 5,323,169 | A * | 6/1994 | Koslover | H01Q 21/08 333/136 |
| 6,201,508 | B1 | 3/2001 | Metzen et al. | |
| 7,564,421 | B1 * | 7/2009 | Edwards | H01Q 13/0241 343/776 |
| 8,477,075 | B2 | 7/2013 | Seifried et al. | |
| 8,587,492 | B2 | 11/2013 | Runyon | |
| 9,257,753 | B2 * | 2/2016 | Milroy | H01Q 25/02 |

(Continued)

OTHER PUBLICATIONS

Natera et al., *New Antenna Array Architectures for Satellite Communications*, Advances in Satellite Communications, Jul. 27, 2011, retrieved Oct. 12, 2019 from https://www.intechopen.com/books/advances-in-satellite-communications/new-antenna-array-architectures-for-satellite-communications.

(Continued)

*Primary Examiner* — Hai V Tran

(74) *Attorney, Agent, or Firm* — Santa Fe IP, LLC

(57) ABSTRACT

A dual-polarized antenna array for a one-dimensional (1D) active electronically steerable array (AESA) includes first and second arrays of open-ended waveguide elements interleaved with one another, each array including a plurality of corporate networks extending transverse to a scan plane SP and having a series of the elements spaced transversely of the scan plane, and wherein each of element is coupled to a respective corporate network by a waveguide twist and oriented oblique to the scan plane. The waveguide elements of one array are oriented orthogonal to the waveguide elements of the other array.

20 Claims, 14 Drawing Sheets

(56) References Cited

U.S. PATENT DOCUMENTS

| | | | | |
|---|---|---|---|---|
| 9,559,428 | B1 * | 1/2017 | Jensen | H01Q 13/06 |
| 10,181,645 | B1 * | 1/2019 | Klein | H01Q 5/45 |
| 10,276,944 | B1 * | 4/2019 | Izadian | H01Q 1/3233 |
| 2002/0149531 | A1 | 10/2002 | Smith et al. | |
| 2008/0238580 | A1 | 10/2008 | Rosenberg et al. | |
| 2010/0171674 | A1 | 7/2010 | Henderson | |
| 2010/0321265 | A1 | 12/2010 | Yamaguchi et al. | |
| 2012/0200449 | A1 | 8/2012 | Bielas | |
| 2013/0120086 | A1 * | 5/2013 | Sarasa Delgado | H01P 1/161 333/21 A |
| 2015/0263429 | A1 * | 9/2015 | Vahidpour | H01Q 1/36 343/770 |
| 2016/0285147 | A1 | 9/2016 | Kroening | |
| 2017/0047661 | A1 * | 2/2017 | Parekh | H01Q 19/132 |

OTHER PUBLICATIONS

Chen, Chao Chun, et al., Ultra-Wideband Phased Arrays, Hughes Aircraft Company, prepared for Air Force Cambridge Research Laboratories, 1973, AD-769965, Fullerton, CA.

* cited by examiner

OPEN ENDED WAVEGUIDE ANTENNA FOR ONE-DIMENSIONAL ACTIVE ARRAYS

CROSS-REFERENCES TO RELATED APPLICATIONS

This application claims priority to U.S. Provisional Patent Application No. 62/693,290 filed Jul. 2, 2018, the entire contents of which is incorporated herein for all purposes by this reference.

BACKGROUND OF INVENTION

Field of Invention

This application relates, in general, to antenna systems for active electronically scanned arrays, and to methods for their use.

Description of Related Art

Antenna arrays with waveguide feed networks exhibit desirably low levels of loss. As the number of waveguide feed elements increases, the waveguide feed networks become increasingly complex and space consuming.

The minimum broad-wall dimension of a waveguide is inversely proportional to the lowest frequency of operation of the antenna array, while the maximum inter-element spacing between waveguide feed elements is inversely proportional to the highest frequency of operation as well as the maximum required scan angle range. As the desired operation bandwidth increases, the waveguide feed network for this type of antenna array becomes particularly challenging to fit in the required inter-element spacing. Furthermore, the inter-element spacing between waveguide feed elements may be constrained by the waveguide feed network size, and in particular the broad-wall dimension, thus limiting antenna scan range performance.

U.S. Pat. No. 9,559,428 to Jensen et al. and U.S. Pat. No. 8,477,075 to Seifried et al. describe examples of all-waveguide broadband dual polarized antenna arrays. Such antennas can be used to generate a fixed beam but are not suitable for electronic scanning.

U.S. Pat. No. 8,587,492 to Runyon describes all-waveguide broadband dual polarized antenna arrays that are electronically scannable in two dimensions (2D). However, such 2D electronically scannable arrays generally require an active beamforming channel for each radiating element in the array, resulting in significant cost and power consumption.

In light of the foregoing, it would therefore be useful to provide a waveguide-based broadband dual-polarization antenna array that can be electronically scanned in one dimension that may be complemented with a suitable positioner to overcome the above and other disadvantages of known antenna arrays.

BRIEF SUMMARY

One aspect of the present invention is directed to a dual-polarized antenna array for a one-dimensional (1D) active electronically steerable array (AESA) including: a first array of open-ended waveguide elements ("first elements"), the array of first elements including a plurality of first corporate networks, each first corporate network extending transverse to a scan plane SP of the antenna array and having a series of the first elements spaced transversely of the scan plane, and wherein each of the first elements is coupled to a respective first corporate network by a first waveguide twist such that each of the first elements is oriented oblique to the scan plane; a second array open-ended waveguide elements ("second elements") interleaved with the first elements, the array of second elements including a plurality of second corporate networks, each second corporate network extending transverse to the scan plane SP of the antenna array and having a series of the second elements spaced transversely of the scan plane, and wherein each of the second elements is coupled to a respective second corporate network by a second waveguide twist such that each of the second elements is oriented oblique to the scan plane and orthogonal to an adjacent first element; and wherein the plurality of first corporate networks and the plurality of second corporate networks are alternately spaced along the scan plane SP of the antenna array.

Each of the first and second corporate networks may include a waveguide diplexer for full duplex operation of the antenna array.

Each of the first and second corporate networks may include a beamformer.

Each first waveguide twist orients a respective first element at a 45° angle relative to the scan plane of the antenna array.

Each of the first and second corporate networks may include an H-plane inter-element distance Dh between adjacent ones of the series of first elements, and adjacent ones of the series of second elements that may be $\geq 0.8\ \lambda$ at the highest operation frequency of the antenna system, and wherein each of the first and second corporate networks may include an E-plane inter-element De between adjacent ones of the series of first elements, and adjacent ones of the series of second elements that may be $\leq 0.7\ \lambda$ at the highest operation frequency of the antenna system.

At least one of the first elements and/or at least one of the second elements may be a dielectric-loaded waveguide element.

At least one of the first elements and/or at least one of the second elements may be a ridged waveguide element.

At least one of the first elements and/or at least one of the second elements may include a wide-angle impedance matching layer.

At least one of the first elements and/or at least one of the second elements may include an iris in the open-ended waveguide element for improved matching.

The first and second elements, the first and second corporate networks, and/or the first and second waveguide twists may be formed of one or more layers of injection molded plastic.

The first and second elements, the first and second corporate networks, and/or the first and second waveguide twists may be formed of 3D printed materials.

At least one of the pluralities of first and second corporate networks may include a waveguide bend for changing direction of high frequency signals propagating therethrough. The waveguide bend may include a corner and a plurality of septa, wherein the septum may be spaced from one another, wherein the septum may be adjacent to but spaced from the corner, and wherein the septum closest to the corner may be taller than the septum farthest from the corner.

The corner may be defined by intersecting planar walls, wherein the septum may be parallel to one of said intersecting planar walls.

The plurality of septa may include three septa, wherein the septum closest to the corner may be taller than a middle septum, and wherein the septum farthest from the corner may be shorter than the middle septum.

The at least one corporate network may be injection molded, and at least one of the plurality of septa may include a draft angle to facilitate removal from an injection mold.

The draft angle may be approximately 0.5°.

An antenna system may include a one-dimensional active electronically steerable array including any of the dual-polarized antenna arrays described above.

Another aspect of the present invention is directed to an antenna array for a dual-polarized antenna system, the antenna array including: a first array of open-ended waveguide elements ("first elements"), the array of first elements including a plurality of first channels extending transverse to a scan plane SP of the antenna array and having a series of the first elements spaced along the first channel, wherein each of the first elements is coupled to a respective first channel by a first waveguide twist such that each of the first elements is oriented oblique to the scan plane; a second array open-ended waveguide elements ("second elements") interleaved with the first elements, the array of second elements including a plurality of second channels, each second channel extending transverse to the scan plane SP of the antenna array and having a series of the second elements spaced along the first, and wherein each of the second elements is coupled to a respective second channel by a second waveguide twist such that each of the second elements is oriented oblique to the scan plane and orthogonal to adjacent first elements; and wherein an H-plane inter-element distance Dh between adjacent ones of the series of first elements, and adjacent ones of the series of second elements that is $\geq 0.8\ \lambda$ at the highest operation frequency of the antenna system; wherein the plurality of first corporate networks and the plurality of second corporate networks are alternately spaced along the scan plane SP of the antenna array; and wherein an E-plane inter-element distance De between adjacent ones of the series of first elements, and adjacent ones of the series of second elements that is $\leq 0.7\ \lambda$ at the highest operation frequency of the antenna system.

Each of the first and second corporate networks may include a waveguide diplexer for full duplex operation of the antenna array.

Each of the first and second corporate networks may include a beam former.

Each first waveguide twist orients a respective first element at a 45° angle relative to the scan plane of the antenna array.

At least one of the first elements and/or at least one of the second elements may be a dielectric-loaded element.

At least one of the first elements and/or at least one of the second elements may be a ridged waveguide element.

At least one of the first elements and/or at least one of the second elements may include a wide-angle impedance matching layer.

At least one of the first elements and/or at least one of the second elements may include an iris in the open-ended waveguide element for improved matching.

The first and second elements, the first and second corporate networks, and the first and second waveguide twists may be formed of one or more layers of injection molded plastic.

The first and second elements, the first and second corporate networks, and the first and second waveguide twists may be formed of 3D printed materials.

At least one of the pluralities of first and second corporate networks may include a waveguide bend for changing direction of high frequency signals propagating therethrough. The waveguide bend may include a corner and a plurality of septa. The septum may be spaced from one another, wherein the septum may be adjacent to but spaced from the corner, and wherein the septum closest to the corner may be taller than the septum farthest from the corner.

The corner may be defined by intersecting planar walls, wherein the septum may be parallel to one of said intersecting planar walls.

The plurality of septa may include three septa, wherein the septum closest to the corner may be taller than a middle septum, and wherein the septum farthest from the corner may be shorter than the middle septum.

The at least one corporate network may be injection molded, and at least one of the plurality of septa may include a draft angle to facilitate removal from an injection mold.

The draft angle may be approximately 0.5°.

A dual-polarized antenna system may include any of the antenna arrays described above.

A further aspect of the present invention is directed to an antenna waveguide for directing high-frequency signals, the antenna waveguide including a waveguide bend for changing direction of high frequency signals propagating through the antenna waveguide, The waveguide bend includes a corner and a plurality of septa, wherein the septum are spaced from one another, wherein the septum are adjacent to but spaced from the corner, and wherein the septum closest to the corner is taller than the septum farthest from the corner.

The corner may be defined by intersecting planar walls, and the septum may be parallel to one of the intersecting planar walls.

The plurality of septa may include three septa, wherein the septum closest to the corner may be taller than a middle septum, and wherein the septum farthest from the corner may be shorter than the middle septum.

At least one of the plurality of septa may include a draft angle to facilitate removal from an injection mold.

The draft angle may be approximately 0.5°.

An antenna array for a one-dimensional (1D) active electronically steerable array (AESA) may include any of the above antenna waveguides, and may include: a first array of open-ended waveguide elements ("first elements"), the array of first elements including a plurality of first corporate networks, each first corporate network extending transverse to a scan plane SP of the antenna array and having a series of the first elements spaced transversely of the scan plane, and wherein each of the first elements is coupled to a respective first corporate network by a first waveguide twist such that each of the first elements is oriented oblique to the scan plane; and a second array open-ended waveguide elements ("second elements") interleaved with the first elements, the array of second elements including a plurality of second corporate networks, each second corporate network extending transverse to the scan plane SP of the antenna array and having a series of the second elements spaced transversely of the scan plane, and wherein each of the second elements is coupled to a respective second corporate network by a second waveguide twist such that each of the second elements is oriented oblique to the scan plane and orthogonal to an adjacent first element; and wherein the plurality of first corporate networks and the plurality of second corporate networks are alternately spaced along the scan plane SP of the antenna array.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In accordance with various aspects of the present invention, antenna arrays are configured to be electronically scannable in only one dimension (1D), and thus only require an active beamforming channel for each row or column of radiating waveguide elements. Mounting the 1D arrays on a suitable positioner may provide two-dimensional (2D) scanning capabilities while avoiding the significant cost and power reduction disadvantages of prior 2D arrays. For example, the 1D arrays of the present invention may be provided with 2D scanning functionality when mounted on a tracking pedestal, such as that described in U.S. Patent Application No. 62/639,926 to Adada et al., the entire content of which application is incorporated herein for all purposes by this reference.

Figure 1:
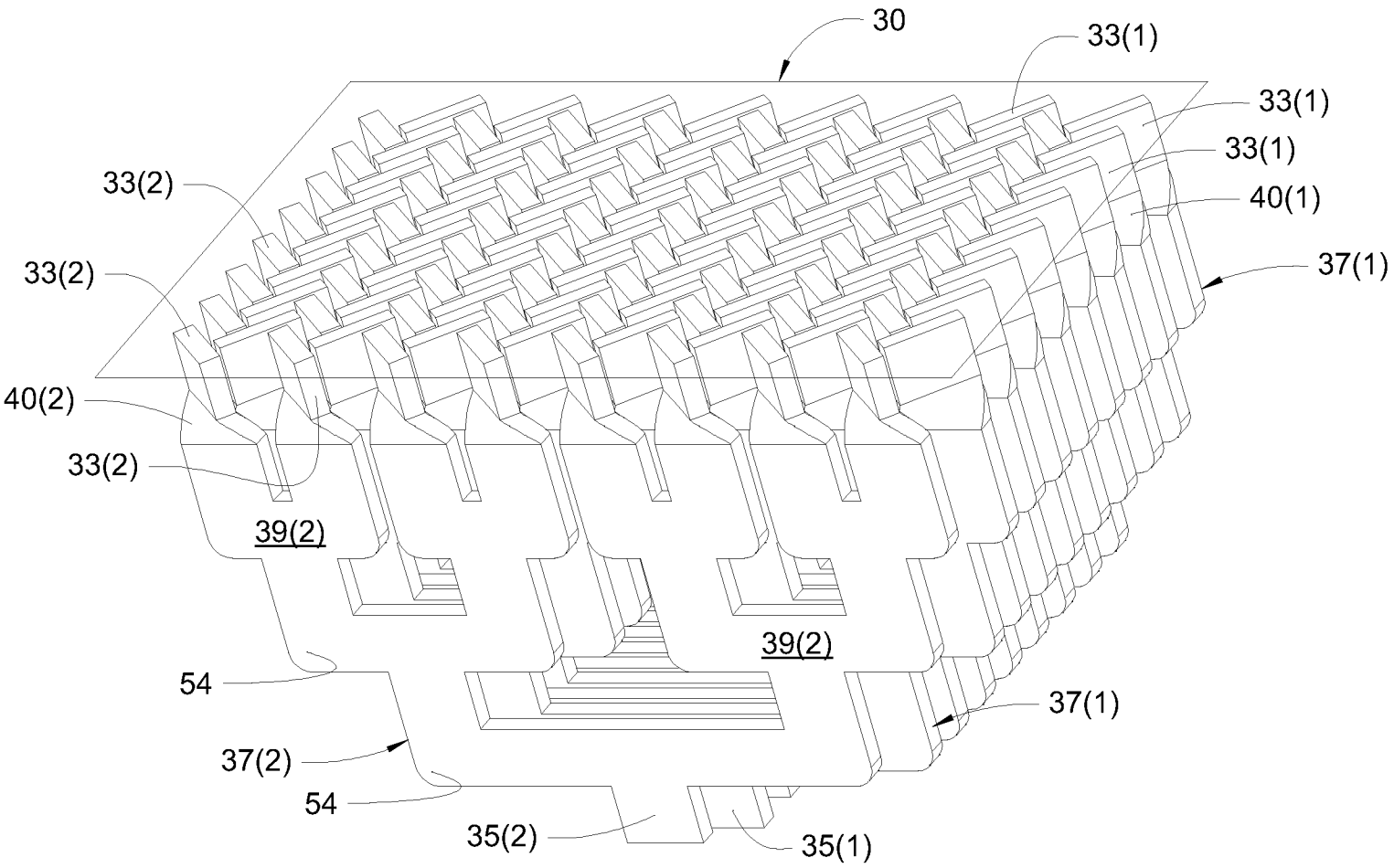
FIG. 1 is a front perspective view of an exemplary active array for a dual-polarized antenna array for one dimensional (1D) scanning in accordance with various aspects of the present invention.
Figure 3A:
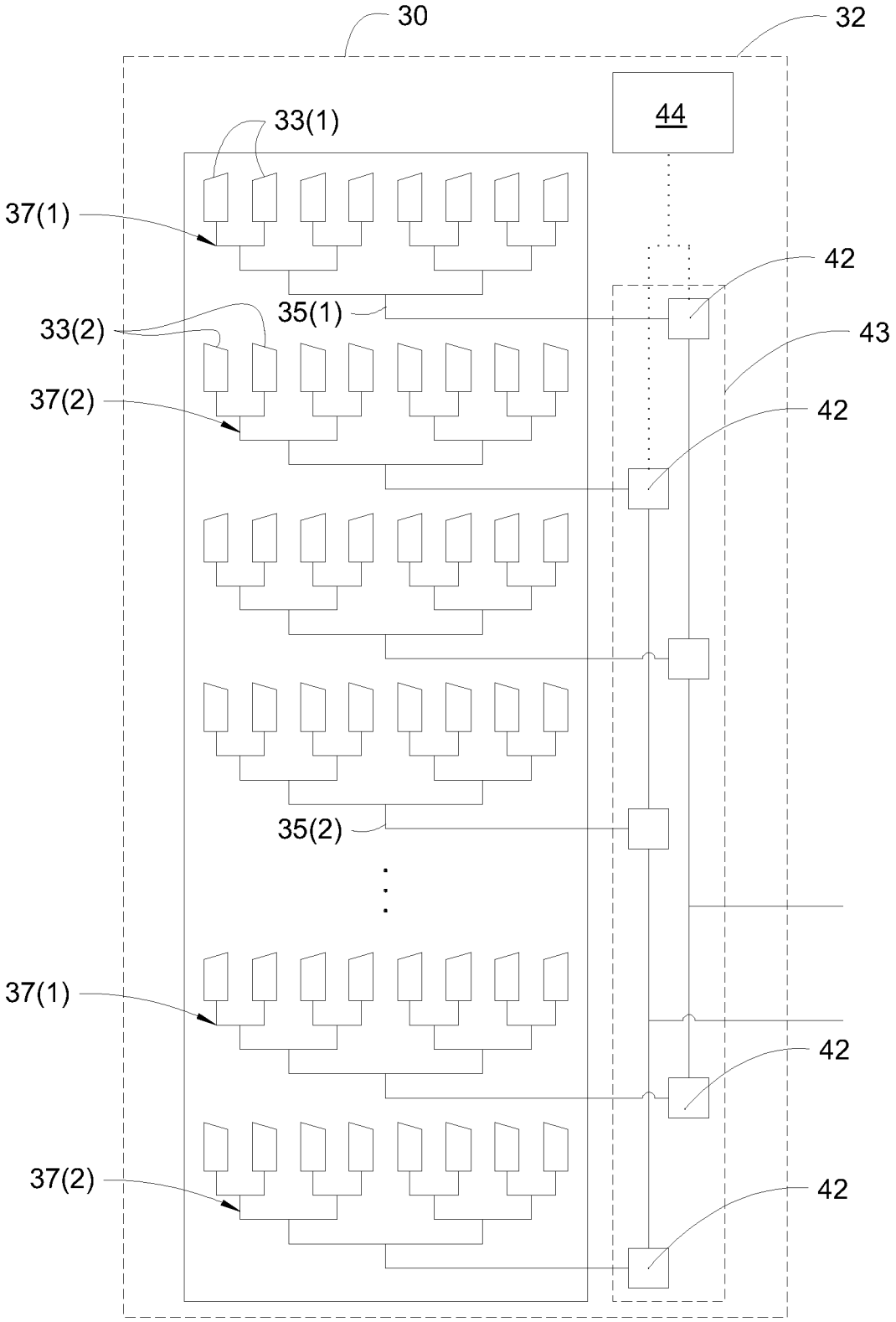
FIG. 3A is a schematic view of an exemplary dual-polarized antenna system incorporating the antenna array of FIG. 1 in accordance with various aspects of the present invention.

Turning now to the drawings, like components are designated by like reference numerals throughout the various figures. In accordance with various aspects of the present invention, an antenna array 30 is shown in FIG. 1 that can be utilized in a one-dimensional (1D) active electronically steerable array (AESA) 32 as shown in FIG. 3A. In various embodiments, the antenna array is a dual-polarized antenna array as shown in FIG. 1

Figure 4:
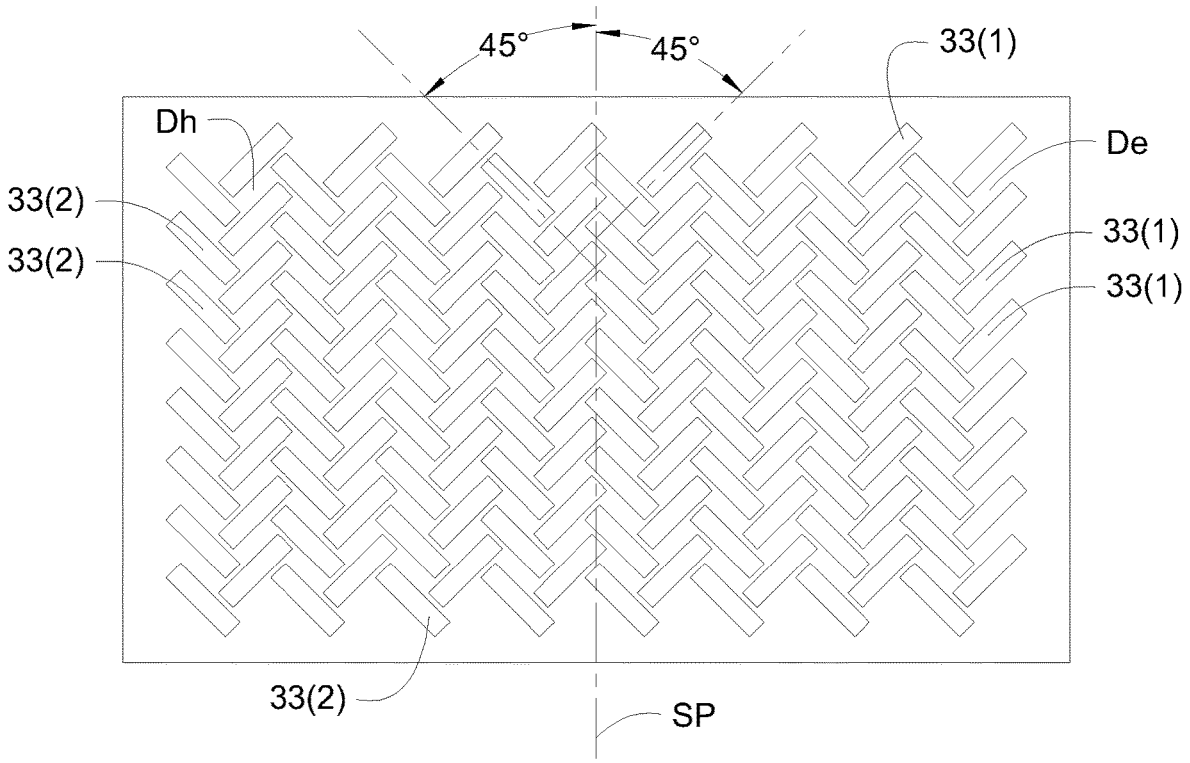
FIG. 4 is a plan view of the antenna array of FIG. 1.

The 1D AESA can be electronically configured to focus a beam of radio frequency waves in different directions within a scan plane SP (see FIG. 4). In addition, the dual polarized antenna system is well suited for full-duplex operation facilitating two-way communications, for example, using a diplexer for transmitting in one frequency and receiving in another.

Generally, the antenna array 30 includes a first array of open-ended waveguide elements ("first elements") 33(1) arranged in rows transverse to the scan plane SP and columns parallel to the scan plane, and a second array of open-ended waveguide elements ("second elements") 33(2) similarly arranged in rows and columns respectively transverse and parallel to the scan plane.

Figure 2:
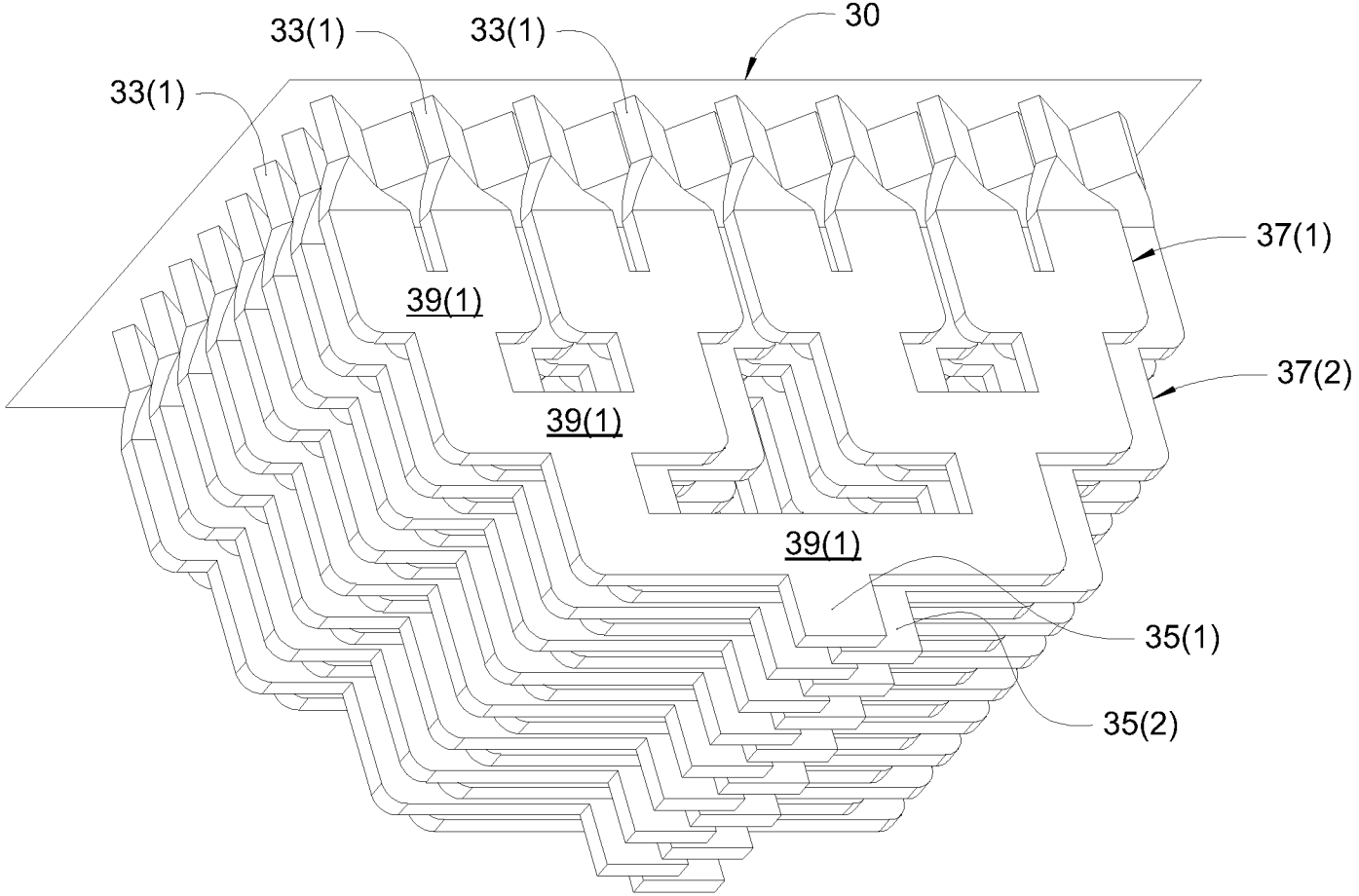
FIG. 2 is a rear perspective view of the exemplary antenna array of FIG. 1.

As shown in FIG. 1 and FIG. 2, each row of first elements 33(1) is a series of open waveguide elements that are operably connected to a common waveguide 35(1) by a first corporate waveguide network 37(1). A plurality of H-Plane combiners/dividers 39 are provided for each corporate waveguide network to divide transmitted signals from its common waveguide 35 to its respective first elements 33, and to combine received signals from its first elements to its common waveguide in an otherwise conventional manner.

Similarly, as shown in FIG. 1 and FIG. 2, each row of second elements 33(2) is operably connected to a common waveguide 35(2) by a second corporate waveguide network 37(2).

With reference to FIG. 4, second elements 33(2) are oriented orthogonally with respect to first elements 33(1) thus providing the dual polarization of the antenna array and the antenna system. For example, the broad-wall dimension (e.g., the H-plane dimension) of first elements 33(1) extends 45° to the right of scan plane SP to facilitate reception and transmission of signals of a first polarization, while the broad-wall dimension of second elements 33(2) extends 45° to the left of scan plane SP to facilitate reception and transmission of a second orthogonal polarization.

And since each corporate waveguide network 37(1), 37(2) interconnects its respective waveguide elements 33(1), 33(2), each corporate network is associated the basis polarization of its waveguide elements. For example, each first corporate waveguide network 37(1) is associated with a first polarization of first elements 33(1), while each second corporate network 37(2) is associated with a second orthogonal polarization of second elements 33(2).

In accordance with various aspects of the present invention, each open-ended waveguide element 33 is operatively connected to its corporate waveguide network 37 via a waveguide twist 40, as shown in FIG. 1. In particular, each first element 33(1) is coupled to a respective first corporate network 37(1) by a first waveguide twist 40(1) thereby positioning the respective open-ended waveguide elements oblique to the scan plane. Similarly, each second element 33(2) is coupled to a respective second corporate network 37(2) by a second waveguide twist 40(2) thereby positioning the respective open-ended waveguide element oblique to the scan plane and orthogonal to the first elements 33(1).

With continued reference to FIG. 1, first waveguide twists 40(1) twist counterclockwise to orient first elements 33(1) in a first direction relative to the H-plane of their first corporate waveguide network 37(1), while second waveguide twists 40(2) twist clockwise to orient second elements 33(2) in a second direction relative to the H-plane of their second corporate waveguide network 37(2). Such configuration allows close interleaving and compact packing of adjacent first and second elements, thus reducing inter-element spacing both along the scan plane SP and transverse to the scan plane SP of the active array. Such configuration also allows for larger radiating elements that fit within the confines of a given inter-element spacing layout.

For example, and with reference to and FIG. 2, each of the first and second corporate networks 37(1), 37(2) may include an H-plane inter-element distance Dh (shown in FIG. 4) between adjacent ones of a series of first elements 33(1), and adjacent ones of the series of second elements 33(2) that is $\geq 0.8\ \lambda$ where $\lambda$ is the wavelength corresponding to the antenna's highest frequency of operation. In various embodiments, the H-plane inter-element distance Dh is in the overall range of approximately 0.8 to 1.0 $\lambda$, preferably approximately 0.87 to 0.97 $\lambda$, and more preferably in the range of 0.90 to 0.96 $\lambda$.

And with continued reference to and FIG. 2, and each of the first and second corporate networks 37(1), 37(2) includes an E-plane inter-element distance De (shown in FIG. 4) between adjacent ones of the series of first elements 33(1), and adjacent ones of the series of second elements 33(2) that is $\leq 0.75\ \lambda$ where $\lambda$ is the wavelength corresponding to the antenna's highest frequency of operation. In various embodiments, the E-plane inter-element distance De is in the overall range of 0.4 to 0.75 $\lambda$, preferably in the range of 0.45 to 0.65 $\lambda$, and more preferably in the range of 0.47 to 0.55 $\lambda$.

The 45° orientation of waveguide elements described above is well suited to provide a compact array design, particularly when the corporate waveguide networks extend orthogonal to the scan plane SP of the active array. Such configuration allows the antenna to have an identical scan loss performance for both polarizations. However, one will appreciate that the specific angular configuration may vary.

With reference to FIG. 1 and FIG. 2, the first corporate networks 37(1) and the second corporate networks 37(2) are alternately spaced along the scan plane SP of the active array. As shown in FIG. 3A, providing each corporate network with a beamforming channel 42 to collectively form a beamformer 43 that allows the active array's scan beam to be steered along the scan plane in a specific angular direction within the scan plane. As shown in FIG. 3A, a controller 44 is provided to control each beam former such that signals may be sequentially delayed (e.g., progressively phase shifted) to the sequentially spaced corporate waveguide networks 37 in order to steer the scan beam plan within the scan plane in an otherwise conventional manner, for example, by phase shifting, true time delay, and/or other suitable means.

Figure 3B:
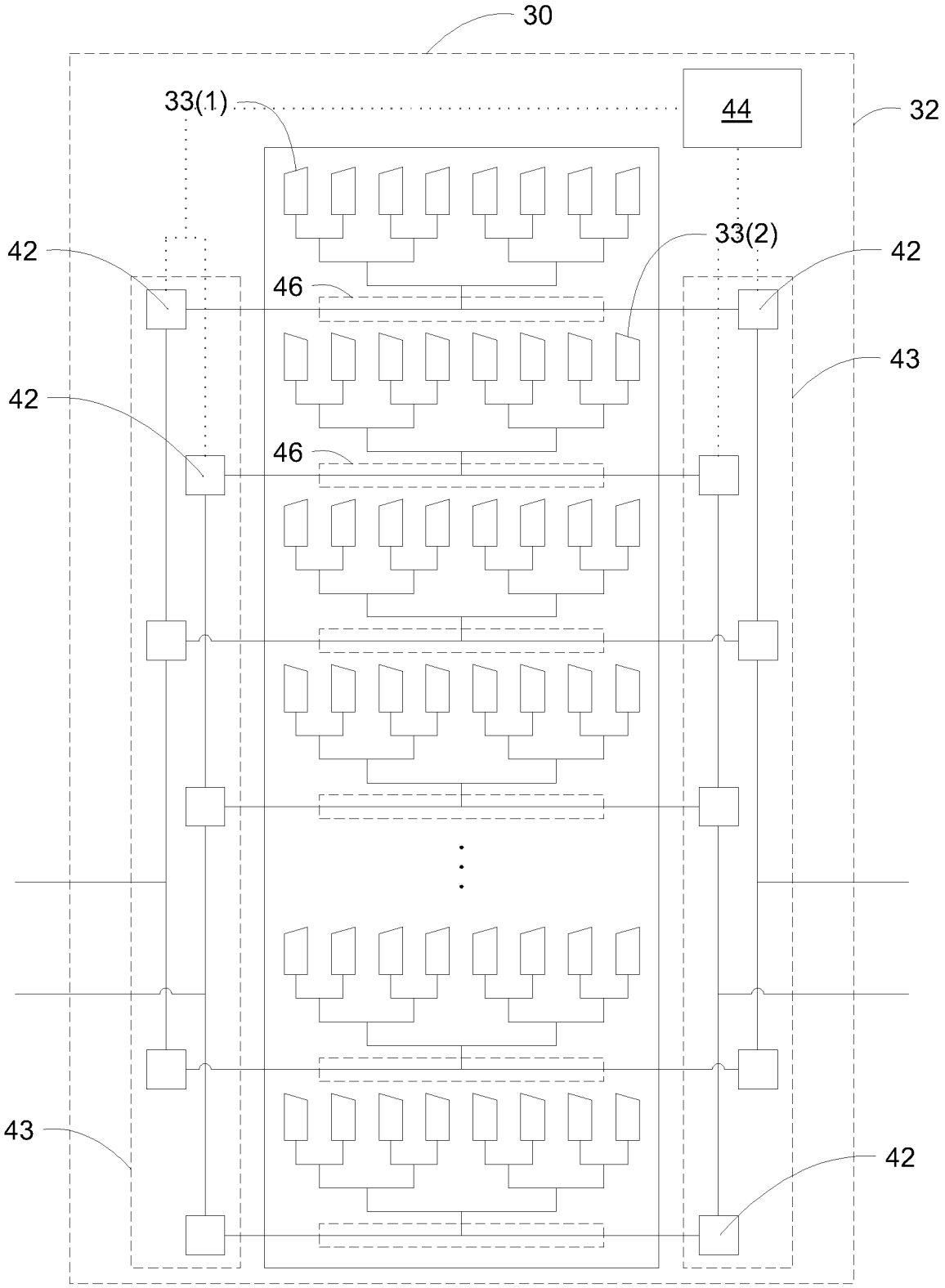
FIG. 3B is a schematic view of another exemplary dual-polarized antenna system incorporating the antenna array similar to that shown in FIG. 3A but including a waveguide diplexer in accordance with various aspects of the present invention.

And with reference to FIG. 3B, each of the corporate networks 37 may also be provided with a diplexer 46 for operation over different frequency ranges in transmission and reception modes. For example, the diplexers may facilitate transmission over a first frequency range and reception over a second frequency range in an otherwise conventional manner.

Figure 5:
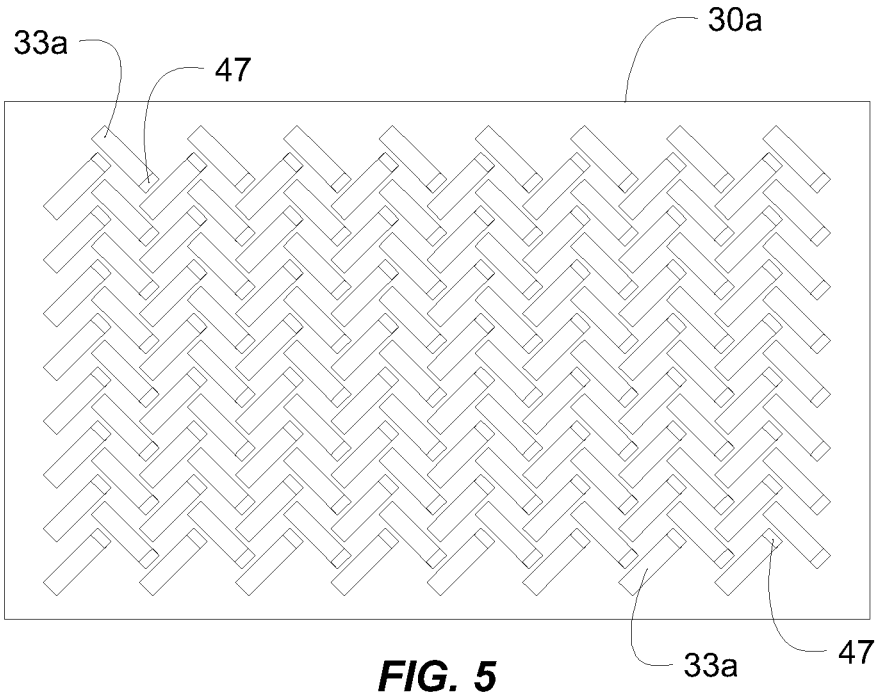
FIG. 5 is a plan view of another antenna array similar to that shown in FIG. 4 and including dielectric-loaded waveguides in accordance with various aspects of the present invention.

With reference to FIG. 5, the open-ended waveguide elements 33*a* of active array 30 may be dielectric-loaded elements. In particular, the waveguide elements may be loaded with a dielectric material 47 to shrink the waveguide's minimum broad-wall dimension required to operate at the lowest frequency of operation and fit within the maximum allowable inter-element spacing required to operate free of grating lobes at the highest operating frequency. One will appreciate that the waveguide elements may be partially loaded as shown, or fully loaded with dielectric material.

Figure 6:
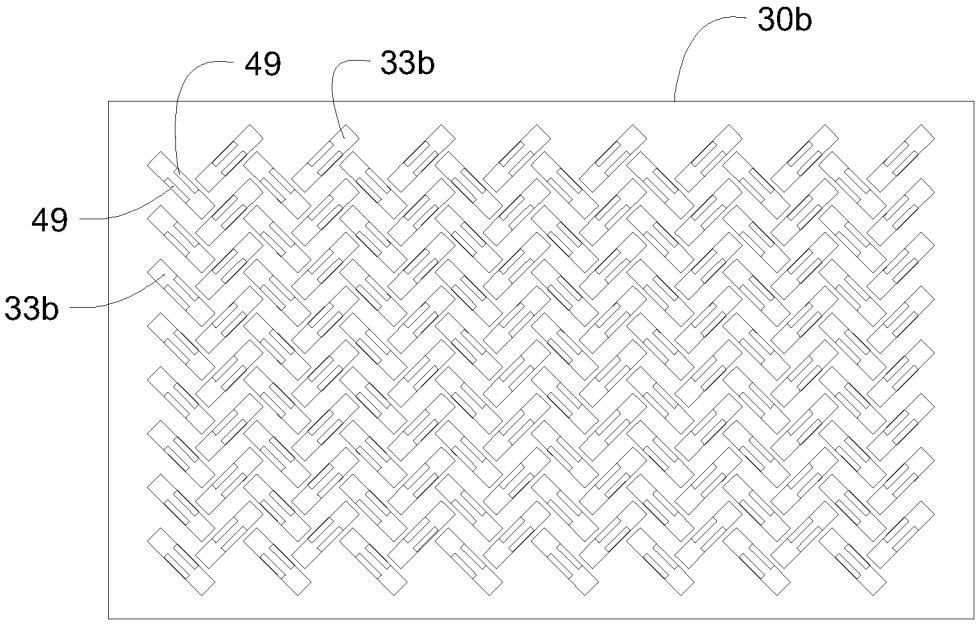
FIG. 6 is a plan view of another antenna array similar to that shown in FIG. 4 and including ridge-loaded waveguides in accordance with various aspects of the present invention.

With reference to FIG. 6, the open-ended waveguide elements 33*b* may be ridge-loaded elements. In particular the waveguide elements may be provided with ridges 49 to shrink the waveguide's minimum broad-wall dimension required to operate at the lowest frequency of operation and fit within the maximum allowable inter-element spacing required to operate free of grating lobes at the highest operating frequency. One will appreciate that the waveguide elements may be dual-ridged waveguide elements as shown or may be single-ridged wherein the waveguide elements are asymmetric having a ridge on only one wall.

Figure 7:
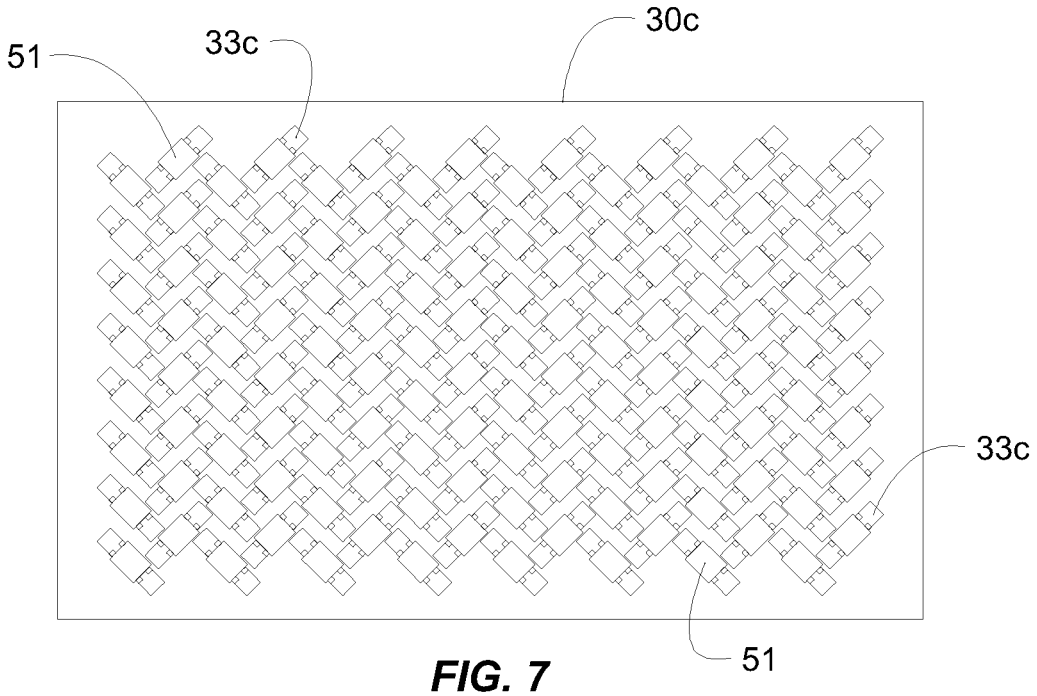
FIG. 7 is a plan view of another antenna array similar to that shown in FIG. 6 and including a patch-based wide angle impedance matching layer in accordance with various aspects of the present invention.

With reference to FIG. 7, the open-ended waveguide elements 33*c* may be provided with a wide-angle impedance matching layer 51 to improve the wide-angle scanning performance of the antenna system. The wide-angle impedance matching layer may be composed of an array of metallic patch-like elements printed on a substrate and fixed at a specific distance away from the open-ended waveguide elements in an otherwise conventional manner.

Figure 8:
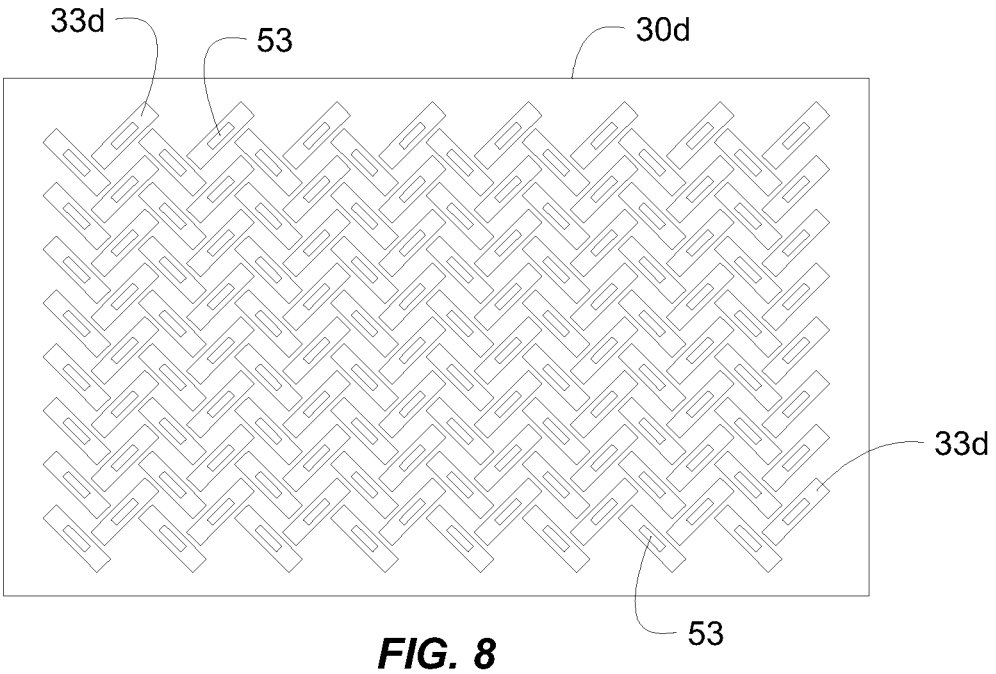
FIG. 8 is a plan view of another antenna array similar to that shown in FIG. 4 and including waveguides having impedance matching irises in accordance with various aspects of the present invention.

With reference to FIG. 8, the open-ended waveguide elements 33*d* may be provided with irises 53 to tune the waveguide as desired and for improved matching. The irises may include thin metal plates across the respective waveguide openings to tune the waveguide element. Although the illustrated irises have a single aperture, one will appreciate that the irises may be provided with multiple apertures.

Figure 9A:
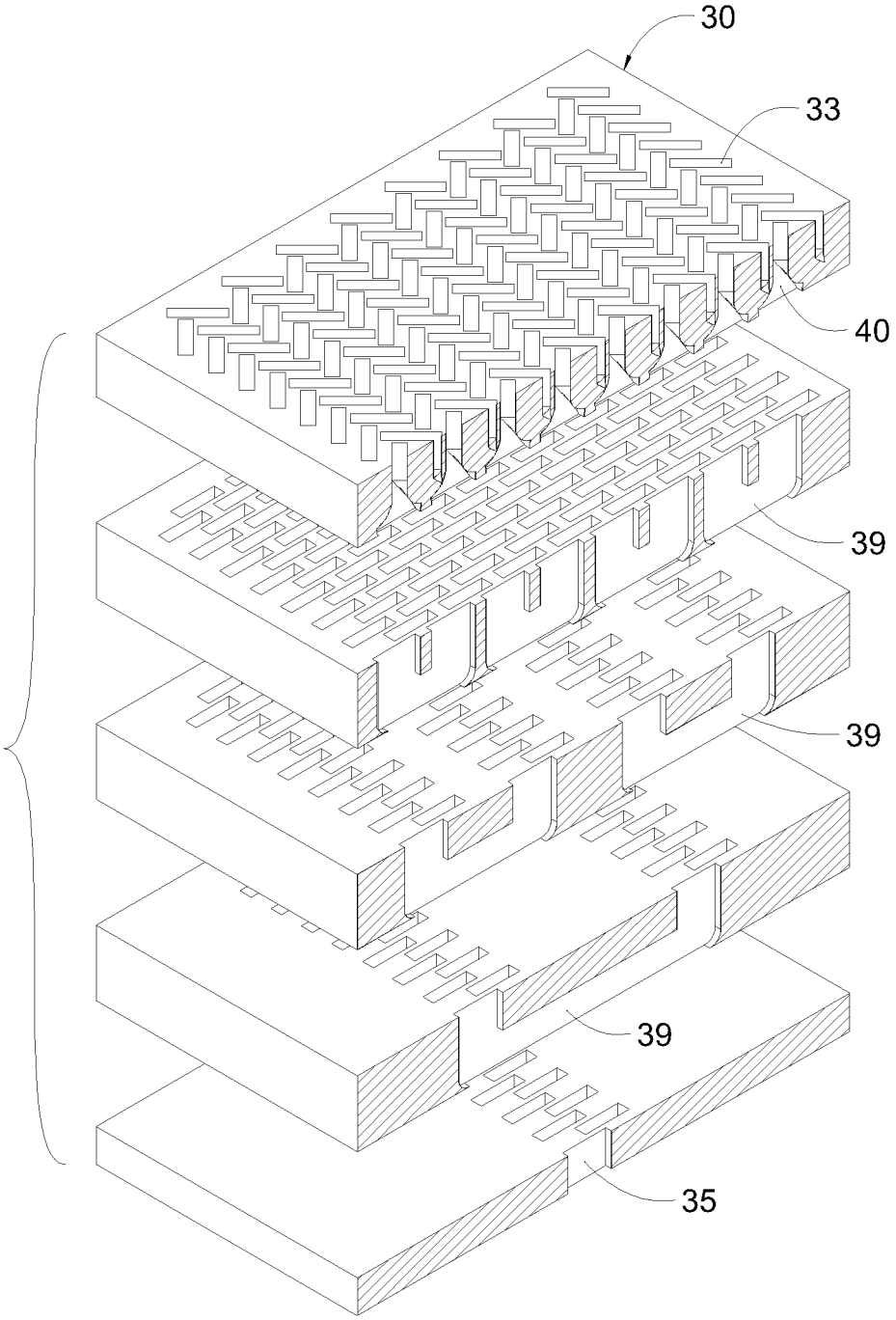
FIG. 9A is an exploded perspective view of a layered waveguide assembly forming the antenna array of FIG. 1, each layer being cross-sectioned to show waveguide passages therein.
Figure 9B:
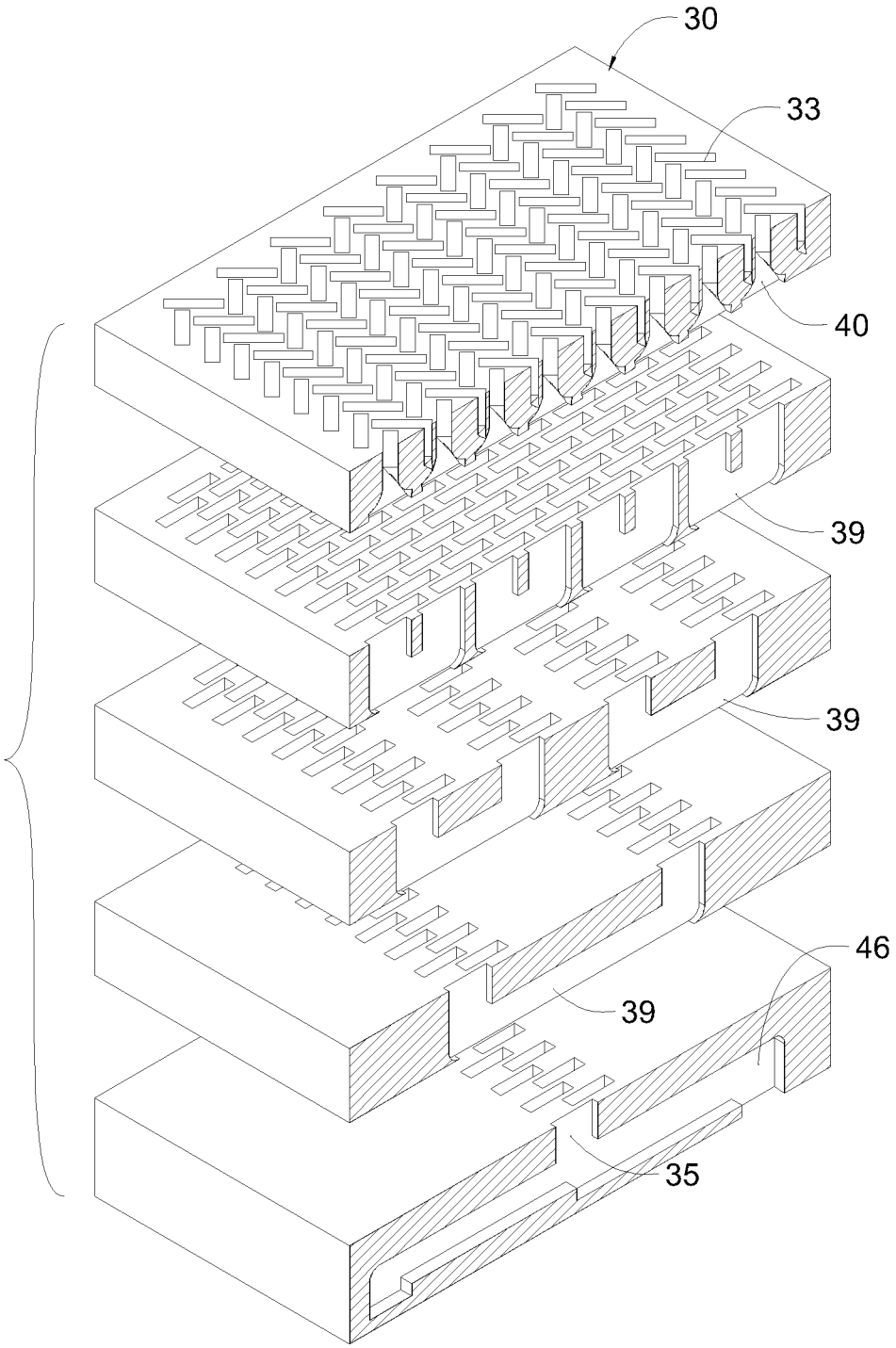
FIG. 9B is an exploded perspective view of another layered waveguide assembly froming an antenna array similar to that shown in FIG. 9A but including a waveguide diplexer in accordance with various aspects of the present invention, each layer being cross-sectioned to show waveguide passages and the diplexer therein.

With reference to FIG. 9A, one will appreciate that antenna array 30 may be fabricated by various manufacturing methods. For example, the active array may include multiple layers of injection-molded materials that may be assembled to form the plurality of open-ended waveguide elements 33, waveguide twists 40, combiners/dividers 39, and common waveguides 35 that collectively form the plurality of corporate waveguide networks 37. Similarly, FIG. 9B illustrates an active array further including a diplexer that is formed in its bottom layer. One will also appreciate that additive manufacturing methods such as 3D printing are particularly well suited to form a plurality of corporate waveguide networks including waveguide twists 40, etc.

Figure 10:
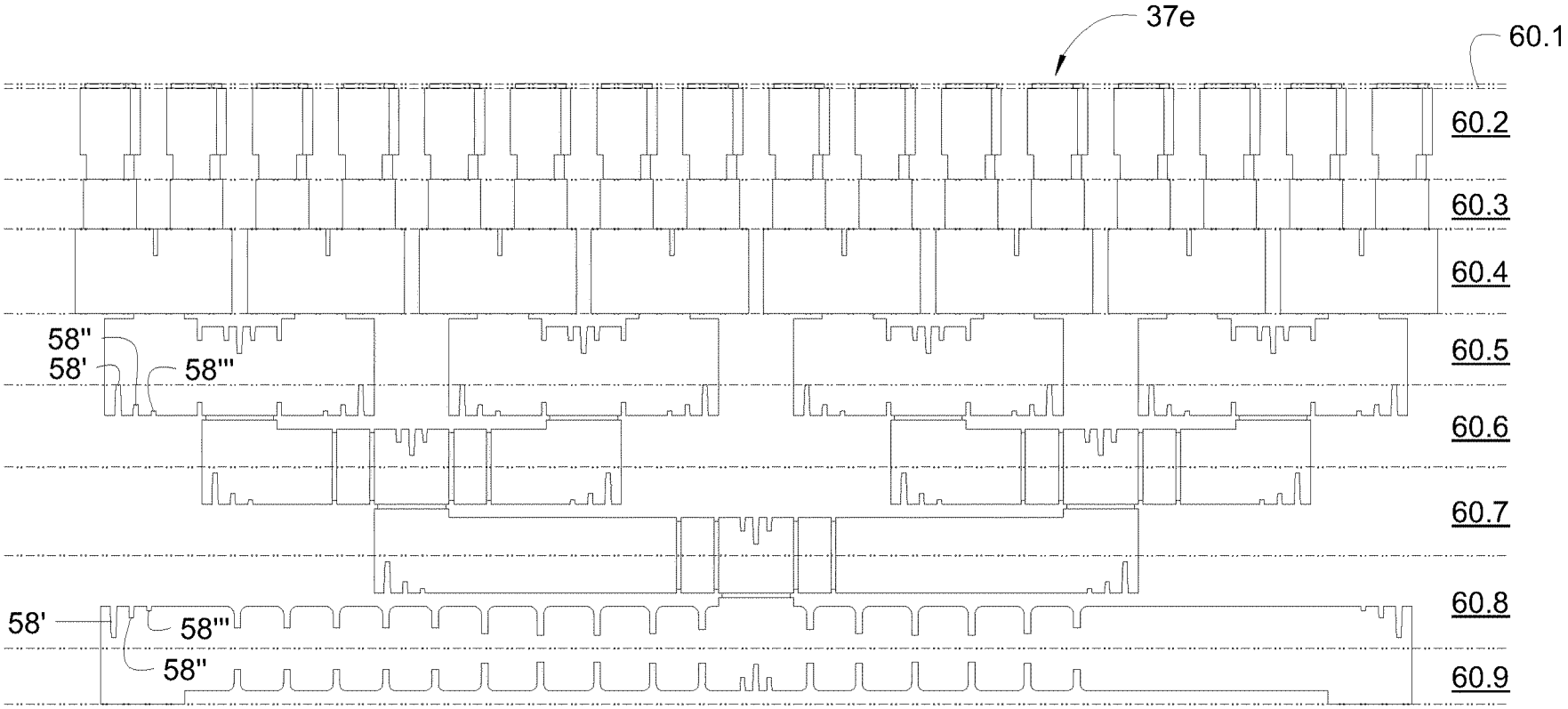
FIG. 10 is a front view of an exemplary corporate waveguide network well-suited for injection molding in accordance with various aspects of the present invention, with dividing lines showing various layers of the corporate waveguide that may be formed separately by injection molding.

Turning now to FIG. 10, a corporate waveguide network 37*e* may be modified in accordance with various aspects of the present invention to simplify an injection molding process. As shown in in FIG. 1 above, waveguide passages may include an RF bend 54 that has a rounded or filleted profile. While the rounded or filleted waveguide passages of a conventional RF bend provides an ideal shape for RF design, such conventional RF bends may not be ideally suited for injection molding. For example, such rounded or filleted corners of a conventional RF bend may leave an excessive wall thickness or a significant volume of plastic behind the bend, and such wall thickness or volume may be prone to sinking as the plastic layer cools. Such sinking may cause shape distortion of the waveguide passages that, if significant, may lead to RF and structural problems. In order to improve injection molding and provide more uniform wall thicknesses, the waveguide passages may be provided with rectilinear corners 56 and multiple septum 58', 58", 58'" approximating the curve of a conventional RF bend of the above-described waveguides.

In particular, a combination of a tall septum 58', a medium septum 58" and a short septum 58'" may be used to approximate rounded or filleted "ideal" RF bends. Performance wise, the septum-bend configuration closely approximates the RF loss performance of a conventional RF bend, and outperforms that of a simple plastic corner as shown in FIG. 11.

Figure 11:
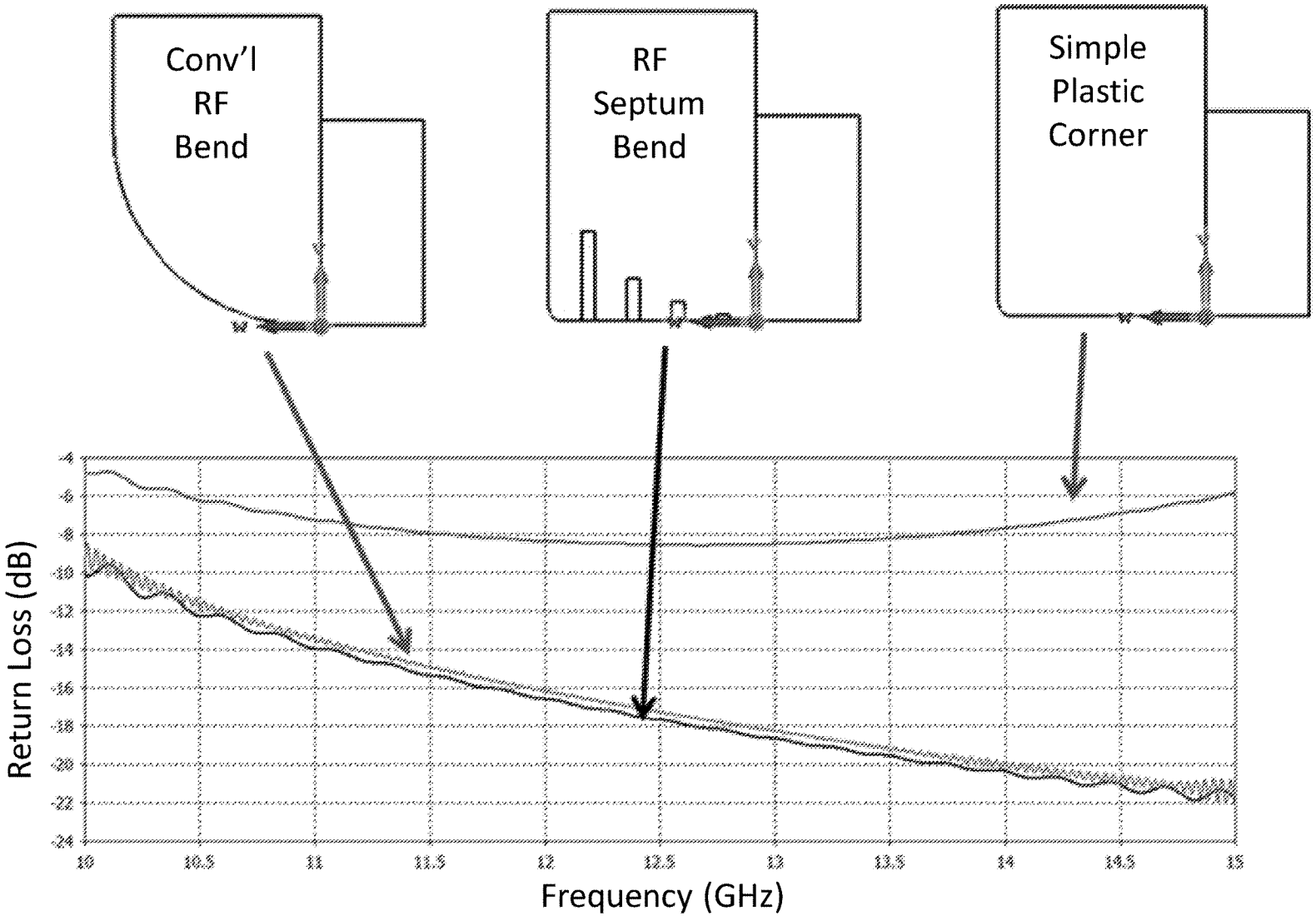
FIG. 11 illustrates comparative waveguide return losses for a conventional RF bend, an RF septum bend in accordance with various aspects of the present invention, and a simple plastic corner.

Although three septum are shown in FIG. 10 and FIG. 11 to approximate the curved corner of an ideal RF bend, one will appreciate that two, three, four or more septum may be used. Preferably, the spacing between adjacent septum is approximately 0.4 λ or less. More preferably, the distance (D) between adjacent septum is between approximately 0.05 λ and 0.35 λ, where λ is the free space wavelength at the target frequency of operation.

Figure 12:
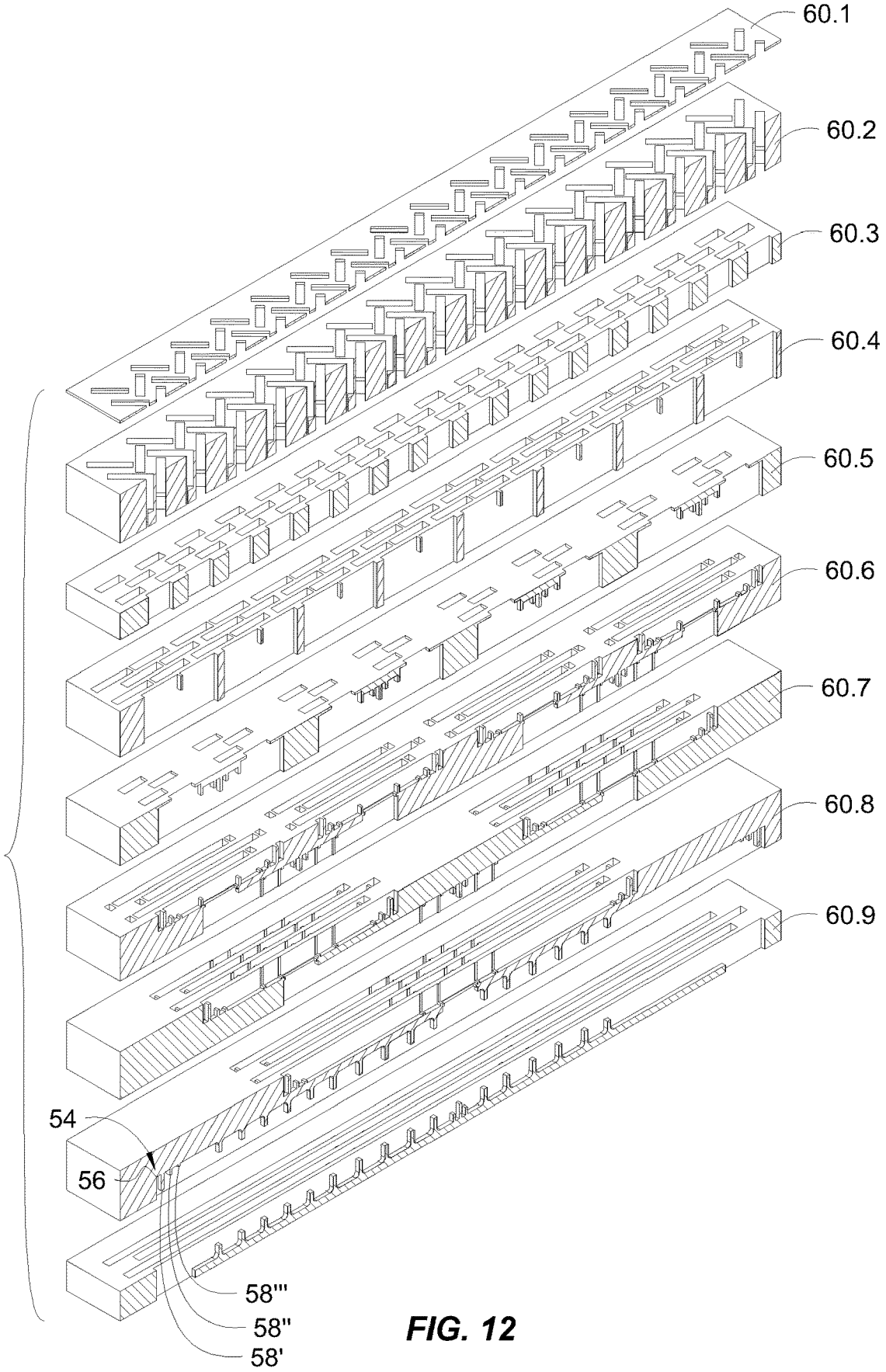
FIG. 12 is an exploded perspective view of another layered waveguide assembly incorporating the corporate waveguide network configuration of FIG. 10 to form an antenna array similar to that shown in FIG. 1, each layer being cross-sectioned to show waveguide passages therein.

Turning now to FIG. 10 and FIG. 12, a corporate waveguide network may be segmented into a number of layers to facilitate the injection molding process. In the illustrated embodiment, corporate waveguide network 37(1)*e* has been segmented into nine layers, with layer 60.1 forming open-ended waveguide irises, layer 60.2 forming open-ended waveguide elements and an upper portion of waveguide twists, layer 60.3 forming a lower portion of the waveguide twists, layer 60.4 forming $4^{th}$ order combiners/dividers, layer 60.5 forming an upper portion of $3^{rd}$ order combiners/dividers, layer 60.6 forming a lower portion of the $3^{rd}$ order combiners/dividers and an upper portion of $2^{nd}$ order combiners/dividers, layer 60.7 forming the lower portion of the $2^{nd}$ order combiners/dividers and an upper portion of a $1^{st}$ order combiner/divider, layer 60.8 forming a lower portion of the $1^{st}$ order combiner/divider and an upper portion of a diplexer, and layer 60.9 forming a lower portion of the diplexer. One will appreciate that the corporate waveguide network may include more or less open-ended waveguide elements along with a corresponding number of combiners/dividers, and the corporate waveguide network may be provided with, or without, an integral diplexer.

Figure 13:
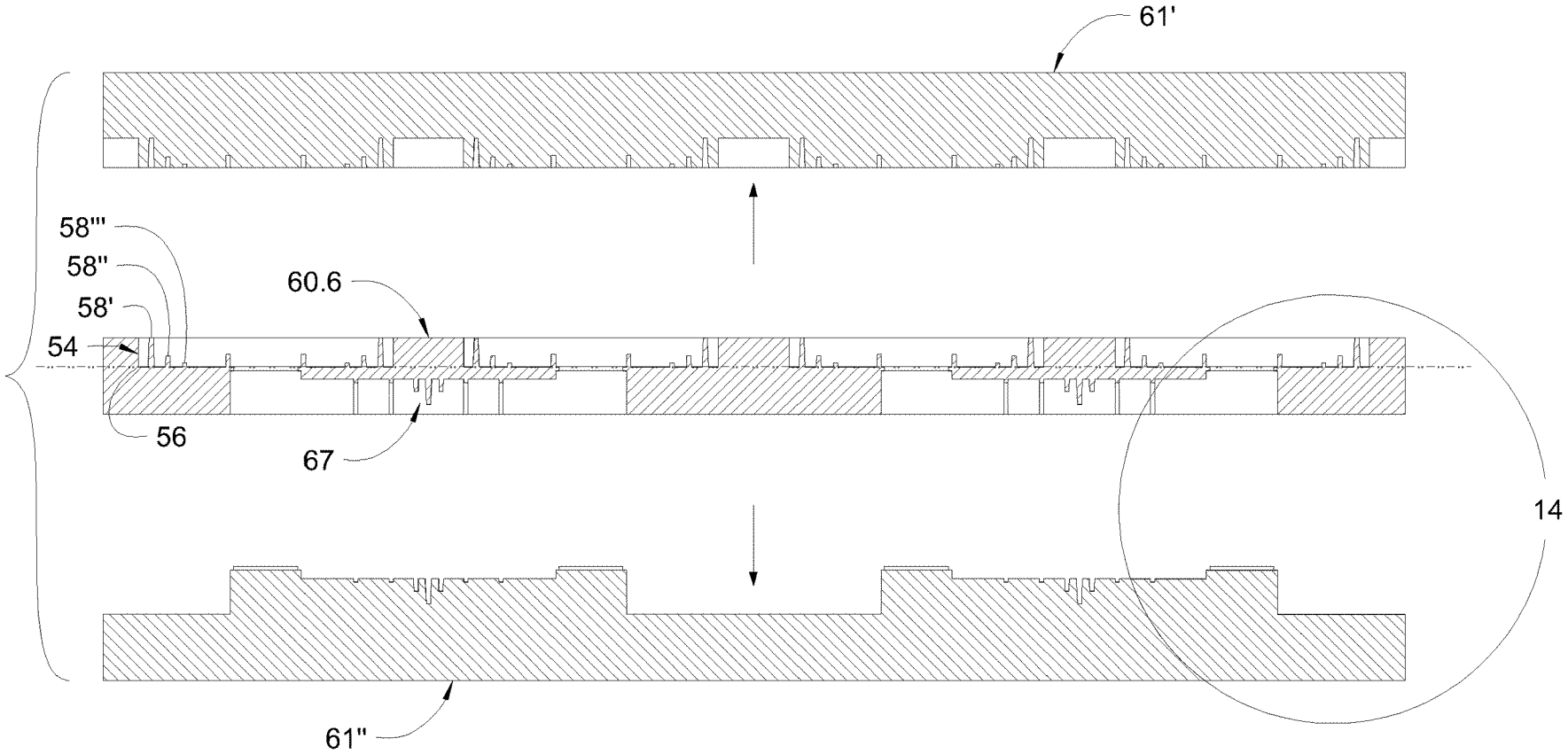
FIG. 13 is a cross-sectional view of one layer shown in FIG. 12 and a mold for injection molding the layer in accordance with various aspects of the present invention.
Figure 14:
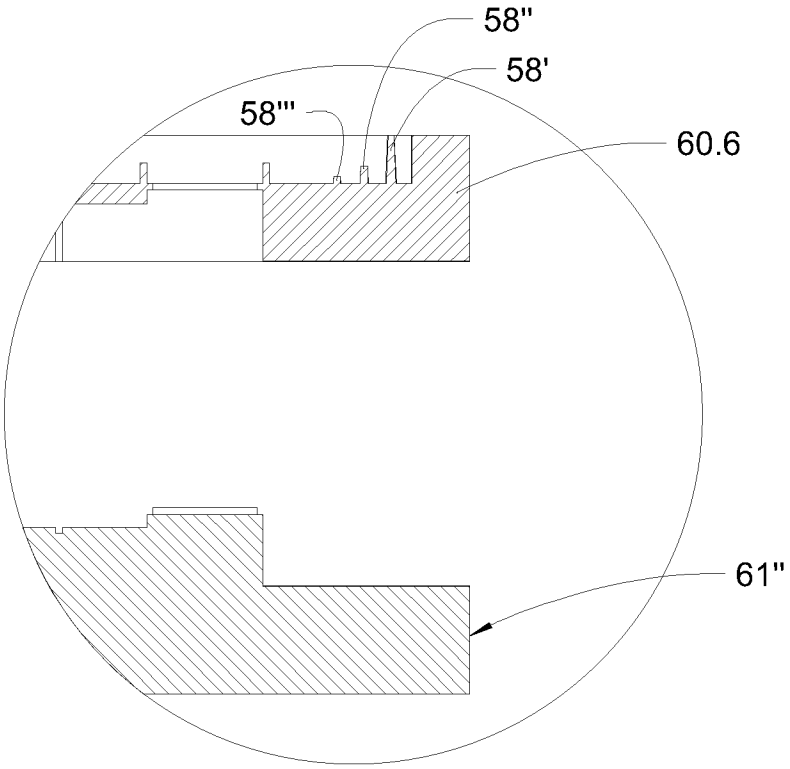
FIG. 14 is an enlarged cross-sectional detail of FIG. 13.

With reference to FIG. 13, the septa generally extend in the mold release direction as indicated by arrows A and B. In particular 58', 58" and 58'" are substantially parallel to the mold release direction such that upper and lower mold halves 61', 61" can be readily withdrawn away from layer 60 once it cools and sets. In various embodiments, the septum may include a slight draft angle DA for easy mold release. For example, FIG. 14 shows septum 58', 58" and 58'" having a 0.5° draft angle. One will appreciate that other draft angles may be utilized, and that a draft angle need not be used in various instances (e.g., with short septum).

Figure 15:
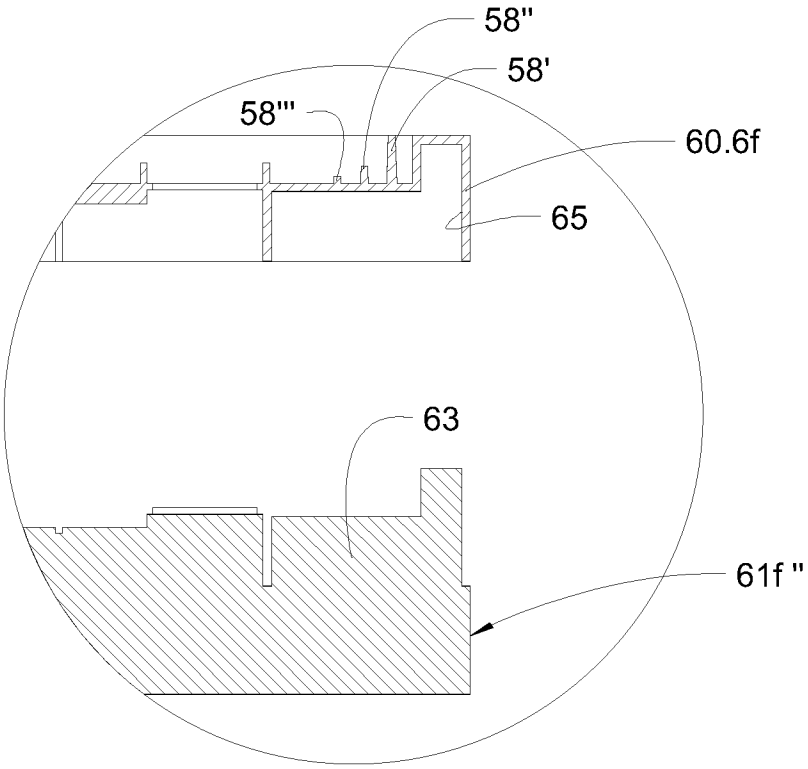
FIG. 15 is another enlarged cross-sectional detail similar to FIG. 14 showing another exemplary waveguide layer and corresponding mold halves in accordance with various aspects of the present invention.

With reference to FIG. 15, one or both mold halves may be modified to provide the waveguide with more uniform wall thicknesses and to avoid large plastic volumes in order to reduce or minimize sinking. For example, mold half 61" may be provided with a protrusion 63 that forms a void 65 which leaves layer 60.6*f* with more uniform wall thicknesses free of large masses of plastic that may be prone to shrinking. Avoiding such plastic shrinking provides a final waveguide assembly substantially free of distortion due to shrinkage. In various embodiments, the resulting wall thicknesses are preferably in the range of 1 mm to 5 mm, and more preferably in the range of approximately 1 mm to 3 mm.

One will appreciate that septum may also be used to approximate the performance of other conventional waveguide features. For example, a plurality of septa may be utilized to closely approximate combiner/divider bends and angles (see, e.g., combiner/divider bend 67 in FIG. 13).

For convenience in explanation and accurate definition in the appended claims, the terms "left" and "right" are used to describe features of the exemplary embodiments with reference to the positions of such features as displayed in the figures.

In many respects, various modified features of the various figures resemble those of preceding features and the same reference numerals followed by subscripts (1) and (2) to designate parts associated with the first and second elements, respectively, and by subscripts "a", "b", "c", "d", "e" and "f" designate corresponding parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A dual-polarized antenna array for a one-dimensional (1D) active electronically steerable array (AESA) comprising:

a first array of open-ended waveguide elements ("first elements"), the array of first elements including a plurality of first corporate networks, each first corporate network extending transverse to a scan plane SP of the antenna array and having a series of the first elements spaced transversely of the scan plane, and wherein each of the first elements is coupled to a respective first corporate network by a first waveguide twist such that each of the first elements is oriented oblique to the scan plane;

a second array open-ended waveguide elements ("second elements") interleaved with the first elements, the array of second elements including a plurality of second corporate networks, each second corporate network extending transverse to the scan plane SP of the antenna array and having a series of the second elements spaced transversely of the scan plane, and wherein each of the second elements is coupled to a respective second corporate network by a second waveguide twist such that each of the second elements is oriented oblique to the scan plane and orthogonal to an adjacent first element; and wherein the plurality of first corporate networks and the plurality of second corporate networks are alternately spaced along the scan plane SP of the antenna array.

2. An antenna array according to claim 1, wherein each of the first and second corporate networks includes a waveguide diplexer for full duplex operation of the antenna array.

3. An antenna array according to claim 1, wherein each of the first and second corporate networks includes a beamformer.

4. An antenna array according to claim 1, wherein each first waveguide twist orients a respective first element at a 45° angle relative to the scan plane of the antenna array.

5. An antenna array according to claim 1, wherein each of the first and second corporate networks includes an H-plane inter-element distance Dh between adjacent ones of the series of first elements, and adjacent ones of the series of second elements that is ≥0.8 λ at the highest operation frequency of the antenna system, and wherein each of the first and second corporate networks includes an E-plane inter-element De between adjacent ones of the series of first elements, and adjacent ones of the series of second elements that is ≤0.7 λ at the highest operation frequency of the antenna system.

6. An antenna array according to claim 1, wherein at least one of the first elements and/or at least one of the second elements is a dielectric-loaded waveguide element.

7. An antenna array according to claim 1, wherein at least one of the first elements and/or at least one of the second elements is a ridged waveguide element.

8. An antenna array according to claim 1, wherein at least one of the first elements and/or at least one of the second elements includes a wide-angle impedance matching layer.

9. An antenna array according to claim 8, wherein the at least one of the first elements and/or at least one of the second elements includes an iris in the open-ended waveguide element for improved matching.

10. An antenna array according to claim 1, wherein the first and second elements, the first and second corporate networks, and/or the first and second waveguide twists are formed of one or more layers of injection molded plastic.

11. An antenna array according to claim 1, wherein the first and second elements, the first and second corporate networks, and/or the first and second waveguide twists are formed of 3D printed material.

12. An antenna array according to claim 1, wherein at least one of the plurality of first and second corporate networks includes a waveguide bend for changing direction of high frequency signals propagating therethrough, the waveguide bend including a corner and a plurality of septa, wherein each septum is spaced from one another, wherein the septa are adjacent to but spaced from the corner, and wherein the septum closest to the corner is taller than the septum farthest from the corner.

13. An antenna array according to claim 12, wherein the corner is defined by intersecting planar walls, wherein each septum is parallel to one of said intersecting planar walls.

14. An antenna array according to claim 12, wherein the plurality of septa include three septum, wherein the septum closest to the corner is taller than a middle septum, and wherein the septum farthest from the corner is shorter than the middle septum.

15. An antenna array according to claim 12, wherein the at least one corporate network is injection molded, and wherein at least one of the plurality of septa includes a draft angle to facilitate removal from an injection mold.

16. An antenna array according to claim 15, wherein the draft angle is approximately 0.5°.

17. An antenna system comprising a one-dimensional active electronically steerable array including the dual-polarized antenna array of claim 1.

18. A dual-polarized array for a one-dimensional (1D) active electronically steerable array (AESA) comprising:

a first array of open-ended waveguide elements ("first elements"), the array of first elements including a plurality of first channels extending transverse to a scan plane SP of the antenna array and having a series of the first elements spaced along the first channel, wherein each of the first elements is coupled to a respective first channel by a first waveguide twist such that each of the first elements is oriented oblique to the scan plane;

a second array open-ended waveguide elements ("second elements") interleaved with the first elements, the array of second elements including a plurality of second channels, each second channel extending transverse to the scan plane SP of the antenna array and having a series of the second elements spaced along the first, and wherein each of the second elements is coupled to a respective second channel by a second waveguide twist such that each of the second elements is oriented oblique to the scan plane and orthogonal to adjacent first elements;

wherein an H-plane inter-element distance Dh between adjacent ones of the series of first elements, and adjacent ones of the series of second elements that is ≥0.8 λ at the highest operation frequency of the antenna system;

wherein the plurality of first corporate networks and the plurality of second corporate networks are alternately spaced along the scan plane SP of the antenna array; and wherein an E-plane inter-element distance De between adjacent ones of the series of first elements, and adjacent ones of the series of second elements that is ≤0.7 λ at the highest operation frequency of the antenna system.

19. An antenna waveguide for directing high-frequency signals, the antenna waveguide comprising a waveguide bend for changing direction of high frequency signals propagating through the antenna waveguide, the waveguide bend including a rectilinear corner having two perpendicular surfaces, and a plurality of septa extending from one of the perpendicular surfaces parallel to the other of the perpendicular surfaces, wherein the septum are spaced from one another, wherein the septum are adjacent to but spaced from the corner, and wherein the septum closest to the corner is taller than the septum farthest from the corner.

20. An antenna waveguide according to claim 19, wherein at least one of the plurality of septa includes a draft angle to facilitate removal from an injection mold.

* * * * *